US007692388B2

(12) United States Patent
Olson

(10) Patent No.: US 7,692,388 B2
(45) Date of Patent: Apr. 6, 2010

(54) METHODS AND APPARATUS FOR REDUCING RADIO FREQUENCY EMISSIONS IN FLUORESCENT LIGHT LAMPS

(75) Inventor: Scot Olson, Scottsdale, AZ (US)

(73) Assignee: Honeywell International Inc., Morristown, NJ (US)

( * ) Notice: Subject to any disclaimer, the term of this patent is extended or adjusted under 35 U.S.C. 154(b) by 927 days.

(21) Appl. No.: 11/350,489

(22) Filed: Feb. 9, 2006

(65) Prior Publication Data

US 2007/0182306 A1 Aug. 9, 2007

(51) Int. Cl.
*H01J 7/44* (2006.01)
*H01J 63/04* (2006.01)

(52) U.S. Cl. ..... 315/49; 313/491; 313/492

(58) Field of Classification Search ..... 315/49, 315/73, 76; 313/491–493, 613, 614
See application file for complete search history.

(56) References Cited

U.S. PATENT DOCUMENTS 4,204,137 A * 5/1980 Roy ..... 313/491
4,492,958 A * 1/1985 Minami ..... 345/174
4,891,551 A * 1/1990 Will et al. ..... 313/492
5,233,268 A * 8/1993 Heuvelmans et al. ..... 313/491
5,686,795 A * 11/1997 Sakoske et al. ..... 313/613
5,841,222 A * 11/1998 Heuvelmans et al. ..... 313/345
6,049,164 A * 4/2000 Van Kemenade et al. .... 313/492

* cited by examiner

*Primary Examiner*—Douglas W Owens
*Assistant Examiner*—Jimmy T Vu
(74) *Attorney, Agent, or Firm*—Ingrassia Fisher & Lorenz, P.C.

(57) ABSTRACT

Methods and apparatus are provided for increasing the life of a fluorescent lamp suitable for use as a backlight in an avionics or other liquid crystal display (LCD). The apparatus includes a channel configured confine a vaporous material that produces an ultra-violet light when electrically excited. A layer of light-emitting material is disposed within at least a portion of the channel is responsive to the ultra-violet light to produce the visible light emitted from the lamp. An electrode assembly that electrically excites the vaporous material includes a first post, a second post, a conductive filament suspended between the first post and the second post and having a tail portion extending therebeyond, and a benign insulating material such as glass frit substantially covering the tail portion to prevent radio frequency (RF) emissions from the tail portion of the filament.

19 Claims, 2 Drawing Sheets

METHODS AND APPARATUS FOR REDUCING RADIO FREQUENCY EMISSIONS IN FLUORESCENT LIGHT LAMPS

TECHNICAL FIELD

The present invention generally relates to fluorescent lamps, and more particularly relates to techniques and structures for improving the life and/or efficiency of fluorescent lamps such as those used in liquid crystal displays.

BACKGROUND

A fluorescent lamp is any light source in which a fluorescent material transforms ultraviolet or other lower wavelength energy into visible light. Typically, a fluorescent lamp includes a glass tube that is filled with argon or other inert gas, along with mercury vapor or the like. When an electrical current is provided to the contents of the tube, the resulting arc causes the mercury gas within the tube to emit ultraviolet radiation, which in turn excites phosphors coating the inside lamp wall to produce visible light. Fluorescent lamps have provided lighting for numerous home, business and industrial settings for many years.

More recently, fluorescent lamps have been used as backlights in liquid crystal displays such as those used in computer displays, cockpit avionics, and the like. Such displays typically include any number of pixels arrayed in front of a relatively flat fluorescent light source. By controlling the light passing from the backlight through each pixel, color or monochrome images can be produced in a manner that is relatively efficient in terms of physical space and electrical power consumption. Despite the widespread adoption of displays and other products that incorporate fluorescent light sources, however, designers continually aspire to improve the amount of light produced by the light source, to extend the life of the light source, and/or to otherwise enhance the performance of the light source, as well as the overall performance of the display.

Accordingly, it is desirable to provide a fluorescent lamp and associated methods of building and/or operating the lamp that improve the performance and lifespan of the lamp. Other desirable features and characteristics will become apparent from the subsequent detailed description of the invention and the appended claims, taken in conjunction with the accompanying drawings and this background of the invention.

BRIEF SUMMARY

In various embodiments, methods and apparatus are provided for increasing the life of a fluorescent lamp suitable for use as a backlight in an avionics or other liquid crystal display (LCD). The apparatus includes a channel configured confine a vaporous material that produces an ultra-violet light when electrically excited. A layer of light-emitting material is disposed within at least a portion of the channel is responsive to the ultra-violet light to produce the visible light emitted from the lamp. An electrode assembly that electrically excites the vaporous material includes a first post, a second post, a conductive filament suspended between the first post and the second post and having a tail portion extending therebeyond, and a benign insulating material such as glass frit substantially covering the tail portion to prevent radio frequency (RF) emissions from the tail portion of the filament.

In another embodiment, a method of forming an electrode assembly suitable for use in a fluorescent light source suitably includes the broad steps of suspending the filament between two conductive posts, trimming the filament, and subsequently applying glass frit or another appropriate insulating material over the tails of the filament that remain after trimming.

Other embodiments include other lamps or displays incorporating structures and/or techniques described herein. Additional detail about various exemplary embodiments is set forth below.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Various techniques for improving the efficiency, luminescence and/or other performance aspect of a fluorescent light source are described herein. For example, a technique for reducing RF emissions emanating from unkempt wires protruding from light source filaments is described below. Each of the various techniques and structures described herein may be independently applied to any and all types of fluorescent light sources, including so-called "aperture lamps", "flat lamps", fluorescent bulbs, and the like.

Figure 1:
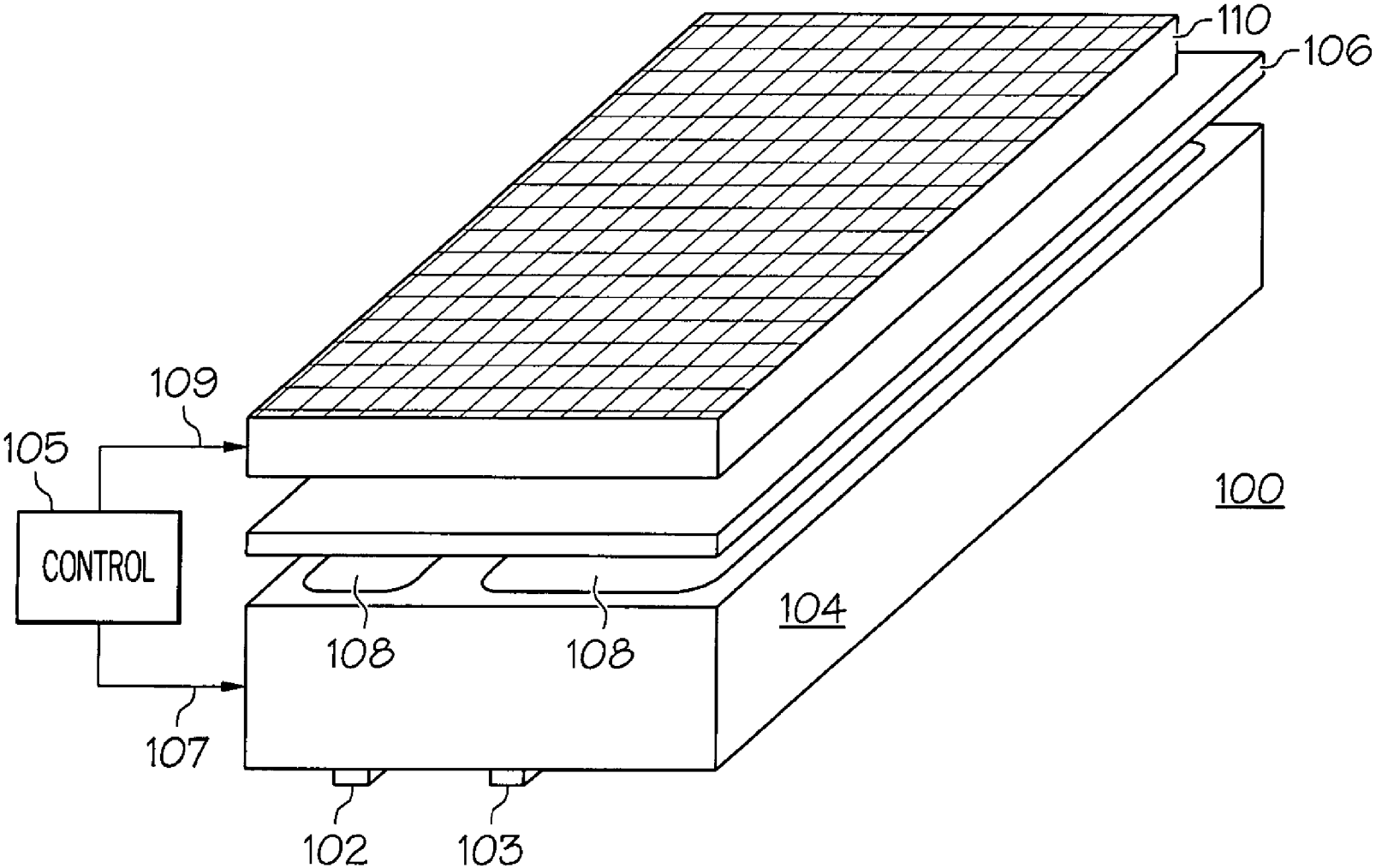
FIG. 1 is an exploded perspective view of an exemplary flat panel display.

Turning now to the drawing figures and with initial reference to FIG. 1, an exemplary flat panel display 100 suitably includes a backlight assembly with a substrate 104 and a faceplate 106 confining appropriate materials for producing visible light within one or more channels 108. Typically, materials present within channel(s) 108 include argon (or another relatively inert gas), mercury and/or the like. To operate the lamp, an electrical potential is created across the channel 108 (e.g. by coupling electrodes 102, 103 to suitable voltage sources and/or driver circuitry), the gaseous mercury is excited to a higher energy state, resulting in the release of a photon that typically has a wavelength in the ultraviolet light range. This ultraviolet light, in turn, provides "pump" energy to phosphor compounds and/or other light-emitting materials located in the channel to produce light in the visible spectrum that propagates outwardly through faceplate 106 toward pixel array 110.

The light that is produced by backlight assembly 104/106 is appropriately blocked or passed through each of the various pixels of array 110 to produce desired imagery on the display 100. Conventionally, display 100 includes two polarizing plates or films, each located on opposite sides of pixel array 110, with axes of polarization that are twisted at an angle of approximately ninety degrees from each other. As light passes from the backlight through the first polarization layer, it takes on a polarization that would ordinarily be blocked by the opposing film. Each liquid crystal, however, is capable of adjusting the polarization of the light passing through the pixel in response to an applied electrical potential. By controlling the electrical voltages applied to each pixel, then, the polarization of the light passing through the pixel can be "twisted" to align with the second polarization layer, thereby allowing for control over the amounts and locations of light passing from backlight assembly 104/106 through pixel array 110. Most displays 100 incorporate control electronics 105 to activate, deactivate and/or adjust the electrical parameters 109 applied to each pixel. Control electronics 105 may also provide control signals 107 to activate, deactivate or otherwise control the backlight of the display. The backlight may be controlled, for example, by a switched connection between electrodes 102, 103 and appropriate power sources. While the particular operating scheme and layout shown in FIG. 1 may be modified significantly in some embodiments, the basic principals of fluorescent backlighting are applied in many types of flat panel displays 100, including those suitable for use in avionics, desktop or portable computing, audio/video entertainment and/or many other applications.

Fluorescent lamp assembly 104/106 may be formed from any suitable materials and may be assembled in any manner. Substrate 104, for example, is any material capable of at least partially confining the light-producing materials present within channel 108. In various embodiments, substrate 104 is formed from ceramic, plastic, glass and/or the like. The general shape of substrate 104 may be fashioned using conventional techniques, including sawing, routing, molding and/or the like. Further, and as described more fully below, channel 108 may be formed and/or refined within substrate 104 by sandblasting in some embodiments.

Channel 108 is any cavity, indentation or other space formed within or around substrate 104 that allows for partial or entire confinement of light-producing materials. In various embodiments, lamp assembly 104/108 may be fashioned with any number of channels, each of which may be laid out in any manner. Serpentine patterns, for example, have been widely adopted to maximize the surface area of substrate 104 used to produce useful light. U.S. Pat. No. 6,876,139, for example, provides several examples of relatively complicated serpentine patterns for channel 108, although other patterns that are more or less elaborate could be adopted in many alternate embodiments.

Channel 108 is appropriately formed in substrate 104 by milling, molding or the like, and light-emitting material is applied though spraying or any other conventional technique. Light-emitting material found within channel 108 is typically a phosphorescent compound capable of producing visible light in response to "pump" energy (e.g. ultraviolet light) emitted by vaporous materials confined within channel 108. Various phosphors used in fluorescent lamps include any presently known or subsequently developed light-emitting materials, which may be individually or collectively employed in a wide array of alternate embodiments. Light emitting materials may be applied or otherwise formed in channel 108 using any technique, such as conventional spraying or the like. In various embodiments, an optional protective layer may be provided to prevent argon, mercury or other vapor molecules from diffusing into the light-emitting material. When used, such a protective layer may be made up of any conventional coating material such as aluminum oxide or the like. Alternatively, various embodiments could include a protective layer that includes fused silica ("quartz glass") or a similar material to prevent mercury penetration.

Figure 2:
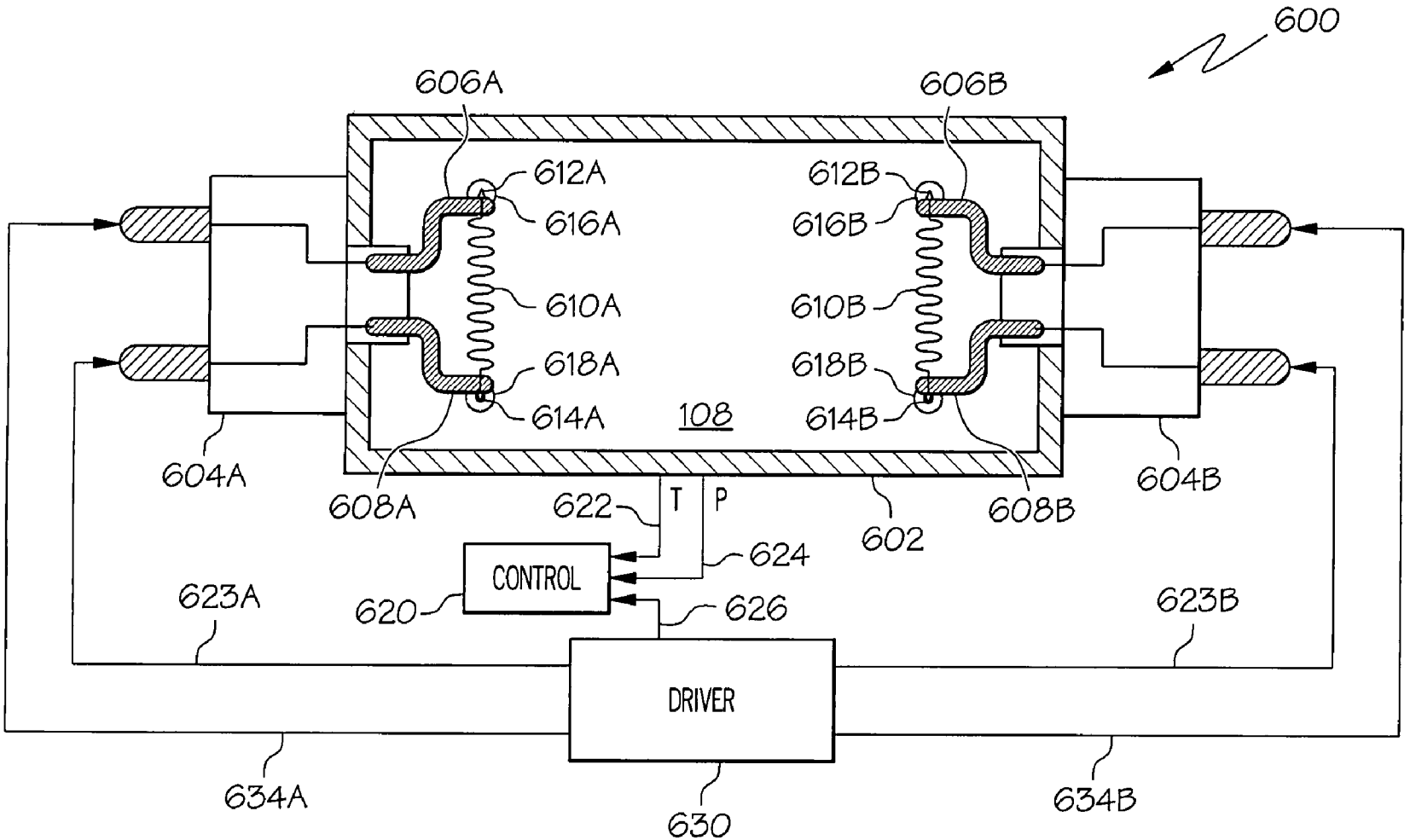
FIG. 2 is a block diagram that shows additional detail of an exemplary fluorescent bulb and the control electronics of an exemplary fluorescent lamp.

Turning now to FIG. 2, an exemplary light producing system 600 suitably includes a fluorescent lamp 602, a driver circuit 630, and optional control circuitry 620. In various embodiments, control circuitry 620 senses and/or controls the temperature, pressure and/or other characteristics of lamp 602, and further provides one or more control signals 626 to driver circuit 630 to produce desired operation of system 600. Driver circuit 630 is typically implemented using any conventional analog and/or digital circuitry to apply any number of control signals 632A-B, 634A-B to produce light in lamp 602. In various embodiments, driver circuit 630 and control circuitry 620 are incorporated within a single device or circuit, and may be further combined with control electronics 105 for display 100 as described above.

Lamp 602 is any bulb or other light source capable of producing fluorescent light resulting from electrical excitation of vaporous materials residing within channel 108, as described above. In various embodiments, lamp 602 suitably includes two or more electrode assemblies 604A-B that provide an interface between external sources of electrical energy and the gas or plasma residing within channel 108. In a conventional implementation, electrode assemblies 604A-B each include two or more electrode posts 606A-B, 608A-B interconnected by one or more filaments 610A-B. In the exemplary embodiment of FIG. 6, for example, one assembly 604A includes two electrode posts 606A and 608A interconnected by filament 610A, and the other assembly 604B includes electrode posts 606A and 608B interconnected by filament 610B. Driver circuit 630 provides appropriate electrical signals 632A-B, 634A-B that can be applied to electrodes 606A-B, 608A-B (respectively) to produce light. In a conventional embodiment, an alternating current is applied across each filament 610A-B, while a voltage difference is applied across channel 108 (e.g. a difference in charge is created between filament 610A and filament 610B) to allow electrons to migrate across the charged plasma within channel 108 from one end to the other. Signals 632A-B and 634A-B may be generated and applied in any manner to implement a wide array of equivalent operating techniques.

In many conventional lamps 602, filaments 610A-B are extended between holes or other gaps in electrode posts 606A-B and 608A-B. Filaments 610A-B may be suspended, for example, between two posts made of nickel or other conductive material. Frequently, after the filaments are stretched between the conductive posts during construction of the lamp, a small segment or "tail" 612A-B, 614A-B remains on the outer portion of electrode posts 606A-B, 608A-B (respectively). Because the voltage difference between the ends of the lamp can be significant in some embodiments (e.g. on the order of a kilovolt or more), tails 612A-B, 614A-B can have adverse effects on the performance or life of lamp 602 if left untreated. If the filament tails 612A-B, 614A-B have sharp end points, for example, and are allowed to remain relatively close to the wall of lamp 602, field emission can result in sputtering of the material at the tail, as well as significant radio frequency (RF) emission. Even if the tails 612A-B, 614A-B are trimmed closer to the posts, RF emission can still occur. To prevent such effects, various embodiments provide a benign insulating material 616A-B, 618A-B such as glass frit or the like over the filament tails 612A-B, 614A-B (respectively). In such embodiments, glass frit can be effectively fired on the filament ends 616A-B, 618A-B after trimming, but before processing and installation in lamp 602. Insulating material 616A-B, 618A-B may be any equivalent material capable of affixing to electrode posts 606, 608 and of insulating or otherwise preventing RF emissions from tails 612, 614. Other embodiments may therefore provide alternate insulating materials other than glass frit as appropriate.

While at least one exemplary embodiment has been presented in the foregoing detailed description of the invention, it should be appreciated that a vast number of variations exist. The techniques described with primary respect to a fluorescent light bulb, for example, could be readily implemented in any sort of flat lamp, aperture lamp or other light source. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims and their legal equivalents.

What is claimed is:

1. A fluorescent light source for providing a visible light, the light source comprising:

a light-emitting channel configured to confine a vaporous material that produces an ultra-violet light when electrically excited;

a layer of light-emitting phosphor material disposed within at least a portion of the channel that is responsive to the ultra-violet light to produce the visible light; and an electrode assembly comprising a first post, a second post, a length of conductive filament suspended between the first post and the second post and having a tail portion extending beyond at least one of the first and second posts, and a benign insulating structure formed from glass frit substantially covering the tail portion and preventing vibration of the tail portion with respect to the at least one of the first and second posts.

2. The light source of claim 1 wherein the benign insulating structure is smaller than the length of the conductive filament.

3. The light source of claim 1 wherein the conductive filament comprises a second tail portion extending beyond the second post in a direction opposite the first post.

4. The light source of claim 3 further comprising a second benign insulating structure displaced over the second tail portion.

5. The light source of claim 4 wherein the second benign insulating structures is made from glass frit.

6. A flat panel display comprising the light source of claim 5.

7. A flat panel display comprising the light source of claim 1.

8. The fluorescent light source of claim 1 wherein the benign insulating structure is configured to prevent vibration of the tail portion.

9. The fluorescent light source of claim 1 wherein the benign insulating structure is configured to prevent vibration of the tail portion to thereby reduce radio frequency (RF) emissions.

10. An electrode assembly for insertion into a fluorescent light source for providing a visible light, the light source comprising a light-emitting channel configured confine a vaporous material that produces an ultra-violet light when electrically excited and a layer of light-emitting phosphor material disposed within at least a portion of the channel that is responsive to the ultra-violet light to produce the visible light, wherein the electrode assembly comprises a pair of electrode posts having a length of conductive filament suspended therebetween and having a tail portion extending outwardly from at least one of the electrode posts, and further comprising a benign insulating structure substantially disposed over the tail portion and preventing vibration of the tail portion with respect to the at least one of the electrode posts, wherein the benign insulating structure is formed of glass frit.

11. The electrode assembly of claim 10 wherein the benign insulating structure is smaller than the length of the conductive filament.

12. The electrode assembly of claim 10 wherein the benign insulating structure is configured to reduce radio frequency (RF) emissions.

13. A fluorescent light source having an electrode assembly configured according to claim 10.

14. A flat panel display having an electrode assembly configured according to claim 10.

15. The electrode assembly of claim 10 wherein the benign insulating structure is configured to prevent vibration of the tail portion.

16. A fluorescent light source for providing a visible light, the light source comprising:

a light-emitting channel configured to confine a vaporous material that produces an ultra-violet light when electrically excited;

a layer of light-emitting phosphor material disposed within at least a portion of the channel that is responsive to the ultra-violet light to produce the visible light; and an electrode assembly comprising a first post, a second post, a conductive filament suspended between the first post and the second post and having a first tail portion extending beyond the first post and a second tail portion extending beyond the second post, a first insulating structure substantially covering the first tail portion to prevent vibration of the first tail portion with respect to the first insulating structure, and a second insulating structure separate from the first insulating structure substantially covering the second tail portion to prevent vibration of the second tail portion with respect to the second insulating structure, wherein the first and second insulating structures are formed from glass frit material.

17. The fluorescent light source according to claim 16 wherein the first and second insulating structures are configured to prevent vibration of the tail portion.

18. The fluorescent light source according to claims 16 wherein the conductive filament has a length and wherein the first and second insulating structures are each smaller than the length of the conductive filament.

19. The fluorescent light source according to claim 16 wherein the first and second insulating structures are configured to prevent vibration of the tail portion to thereby reduce radio frequency (RF) emissions.

* * * * *